US007735499B1

(12) United States Patent
Pennise

(10) Patent No.: US 7,735,499 B1
(45) Date of Patent: Jun. 15, 2010

(54) ACTIVITY WALKER

(76) Inventor: Paul A Pennise, 312 Washington St., East Greenville, PA (US) 18041

( * ) Notice: Subject to any disclaimer, the term of this patent is extended or adjusted under 35 U.S.C. 154(b) by 0 days.

(21) Appl. No.: 12/276,521

(22) Filed: Nov. 24, 2008

(51) Int. Cl.
*A61H 3/04* (2006.01)

(52) U.S. Cl. ..... 135/67; 135/85; 297/5; 482/68; 280/87.051

(58) Field of Classification Search ..... 135/65–67, 135/84, 85; 280/87.01, 87.051, 87.05, 87.021; 482/67–69, 36, 38–39; 297/5–9
See application file for complete search history.

(56) References Cited

U.S. PATENT DOCUMENTS

| | | | | | |
|---|---|---|---|---|---|
| 116,073 | A | * | 6/1871 | Maschmann | 280/87.051 |
| 572,613 | A | * | 12/1896 | Packard | 482/68 |
| 2,538,324 | A | * | 1/1951 | Petrie | 280/87.051 |
| 4,188,966 | A | | 2/1980 | Palmer et al. | |
| 4,312,505 | A | | 1/1982 | Engelhart | |
| 4,621,804 | A | * | 11/1986 | Mueller | 280/87.041 |
| 4,765,355 | A | | 8/1988 | Kent | |
| 4,770,410 | A | * | 9/1988 | Brown | 482/68 |
| 4,941,497 | A | | 7/1990 | Prather et al. | |
| 4,953,851 | A | | 9/1990 | Sherlock et al. | |
| 5,040,556 | A | * | 8/1991 | Raines | 135/67 |
| 5,080,383 | A | | 1/1992 | Hseih | |
| 5,083,806 | A | * | 1/1992 | Brown | 280/87.05 |
| 5,174,590 | A | | 12/1992 | Kerley et al. | |
| 5,224,731 | A | | 7/1993 | Johnson | |
| 5,228,708 | A | * | 7/1993 | Verdugo | 280/200 |
| 5,275,426 | A | * | 1/1994 | Tankersley | 280/87.051 |
| 5,382,033 | A | | 1/1995 | Cheu | |
| 5,588,456 | A | * | 12/1996 | Hart | 135/67 |
| 5,662,344 | A | | 9/1997 | Lu | |
| 5,702,326 | A | | 12/1997 | Renteria | |
| 5,728,030 | A | | 3/1998 | Hseih | |
| 5,743,836 | A | | 4/1998 | Lo | |
| 5,823,613 | A | | 10/1998 | Yi | |
| 6,120,045 | A | | 9/2000 | Rosko | |
| 6,170,840 | B1 | * | 1/2001 | Mathias | 280/87.041 |
| 6,260,867 | B1 | | 7/2001 | Yang et al. | |
| 6,449,785 | B1 | | 9/2002 | Liljedahl | |
| 6,503,176 | B2 | | 1/2003 | Kuntz | |
| 6,527,285 | B1 | * | 3/2003 | Calandro, II | 280/87.051 |
| 6,578,594 | B1 | | 6/2003 | Bowen et al. | |

(Continued)

FOREIGN PATENT DOCUMENTS

| | | | |
|---|---|---|---|
| FR | 2560766 | A1 * | 9/1985 |

*Primary Examiner*—Winnie Yip
(74) *Attorney, Agent, or Firm*—Paul & Paul

(57) ABSTRACT

An activity walker has three wheeled legs positioned about an adjustable trunk surround member. The trunk surround member is hinged to open and is curved to approximate a users oval-shaped midriff. An adjustable closure on the torso/trunk surround member compensates for users of various girths. A flexible sling support extends across the interior of the surround member from its rear portion to its front portion, with fixed rearward attachments and a releasable front attachment to the interior of the surround member. This sling support is shaped to pass between a user's legs and provides body/trunk support when the user is standing upright. A length of each leg may be adjustable. The lateral extension of each leg outwardly from the surround member may be adjustable to reconfigure the stance/footprint of the walker. A friction pin may be utilized to adjust the rolling rate of each wheel.

19 Claims, 6 Drawing Sheets

U.S. PATENT DOCUMENTS 6,609,719 B2 * 8/2003 Heien ..... 280/5.26
7,108,004 B2 9/2006 Cowie et al.
7,150,722 B1 12/2006 Tyrrell

* cited by examiner

ACTIVITY WALKER

BACKGROUND OF THE INVENTION

The present invention is directed to a walking aid for use while playing billiards, or working at a workbench, or working at a kitchen counter.

"Walkers" have been designed for two basic classes of individuals. The first class includes: baby walkers for toddlers learning to walk; and assisted aid walkers for disabled or aged individuals. The second class includes: therapeutic and rehabilitative walkers for injured or disabled individuals.

Regardless of which class of walker, these walkers generally have been built along two design approaches. A first design approach requires the individual to sit in a seated position and then either move the walker-device in a shuffling motion, or raise himself up to a standing position to walk within the perimeter of the walker by grasping a member of the walker structure for support and to control the direction and movement of the walker.

A second design approach provides a walker with a support perimeter. This type of device can include wheels at the bottom of its legs or not. It also can include a superstructure extending above the individual. Included in this design approach are walkers which cage-in the individual and support the individual's entire weight with a harness or other means.

Unless the walker has a harness, the individual is required to grasp some portion of the walker when moving about in order to keep control of the walker. If the walker has a rigid seat, or a non-rigid full seat, the individual is required to sit in a seated position and shuffle his feet/foot to move the walker structure.

Walker manufacturers have previously designed walkers for sufficiently unstable individuals, each prior art walker has required four legs for stability regardless of whether they include wheels or not. Moreover, these prior art walkers place significant structure extending in front of the individual. This front structure precludes an individual from being able to get very close to a device, such as a pool table, a work bench, or a kitchen counter. For those devices which enable an individual to stand and walk freely, the individual is required to grasp the walker to control its movement. This keeps the individual's hands occupied and precludes other hand activities while moving the walker.

Sherlock, et al., U.S. Pat. No. 4,953,851, discloses an example of a walker with operational limitations which the present invention overcomes. Sherlock includes a rigid circular rim/ring which surrounds an individual. The rim has an arc section which is pivoted and pinned to be opened for an individual to enter the ring. When the Sherlock full flexible seat is attached to four predetermined positions on the ring, an individual is required to sit in a seated position and shuffle the walker about. To stand upright within the Sherlock walker, the seat must be repositioned into a folded hanging position to clear the ring area. The ring is padded for comfort when an individual grasps it. An individual in the standing position, with the seat folded away, grasps the rim to control the movement of the Sherlock wheeled walker. The Sherlock walker with its fixed size ring, its wheeled support legs and its brace members limits a walking individual's stride and ability to freely change direction of travel.

An objective of the present invention is to provide an activity walker which permits an individual to walk and move the walker about without hand-grasping a portion of the walker's structure.

Another objective is that this activity walker has minimal structure in front of an individual using it.

A further objective is that this activity walker is adjustable in height, the lateral extension of its legs, and the size of a support member which surrounds the trunk portion of an individual.

An additional objective is that this activity walker supports the trunk portion of an individual while the individual is in a standing position or while walking.

An also further objective is that this activity walker's trunk support member permits upright walking with minimal interference with a normal stride.

SUMMARY OF THE INVENTION

The objectives of the invention are realized in a relatively light weight, reasonably small footprint, activity walker, i.e. a walking and standing aid, having a substantially minimal front structure which not would interfere with a proximal approach to a fixed object.

The activity walker provides support to the user's body/trunk portion when in the standing position, thereby freeing the user's hands for other activities. The device also provides support to the user's body/trunk when walking and subjects the user's stride to minimal interference.

A trunk support surround member is adjustable to fit the user's trunk/body at midsection in close proximity, thereby freeing the user's hands both when standing and when moving about in the walker. Support legs attached to the surround member are adjustable in length to fit the user's height and adjustable outwardly to adjust the footprint of the walker to compensate for the user's standing instability and/or walking instability.

The activity walker has three wheeled legs positioned about the adjustable trunk surround member and fixed thereto. Caster wheels are attached to the bottom end of each leg. The length adjustments for legs use a series of fixed detents at predetermined increments. This structure is implemented with a spring biased button and a series of adjustment holes or with a set screw which permits a continuous adjustment in infinitely small increments.

The surround member is a rigid two-section walled structure forming a cylindrical-like body support. The two sections of the surround member are connected with a hinge at the back of the walker to permit the surround member to open for a user to enter the walker. A flexible front closure secures the two sections together at the front of the walker. The front closure is adjustable to enable the free ends of each section to overlap a distance, as needed, to compensate for a range of user midriff sizes.

The two sections of the surround member are curved to approximate a user's oval-shaped midriff. Cushioning is mounted onto the inner surface of each of the two surround sections. This cushioning permits the surround member to be drawn into close proximity to a user's trunk in the region of the midriff and hips and provides comfort to the user in conforming to the individual user's shape. The surround member has a wall height which allows it to extend from about the lower rib to below the hip joint of a user.

When the user becomes unstable when either standing or walking, his midriff leans against the inside of the surround member which intercepts the user's further movement, much as leaning against a railing or wall to intercept a fall. The walker's legs hold the trunk support surround member to keep the user upright.

A flexible sling support extends across the interior of the surround member from the rear of the walker to its front. This support has fixed rearward attachments to the interior wall of the surround member, and a releasable front attachment to the interior of the trunk surround. The sling support is positioned and shaped to be able to pass between a user's legs and in order to provide body/trunk support while the user is standing upright or walking.

A friction pin may be utilized to adjust the rolling rate of each wheel. The friction pin is mounted to pass through the wall of each caster bracket. This pin is incremented to indicate friction pressure. A friction pin engages an annular pressure surface on the respective wheel. By adjusting the pin pressure against a wheel the force needed to rotate the wheel is changed.

BRIEF DESCRIPTION OF THE DRAWINGS

The features, advantages and operation of the present invention will become readily apparent and further understood from a reading of the following detailed description with the accompanying drawings, in which like numerals refer to like elements, and in which.

DETAILED DESCRIPTION OF THE INVENTION

Figure 1A:
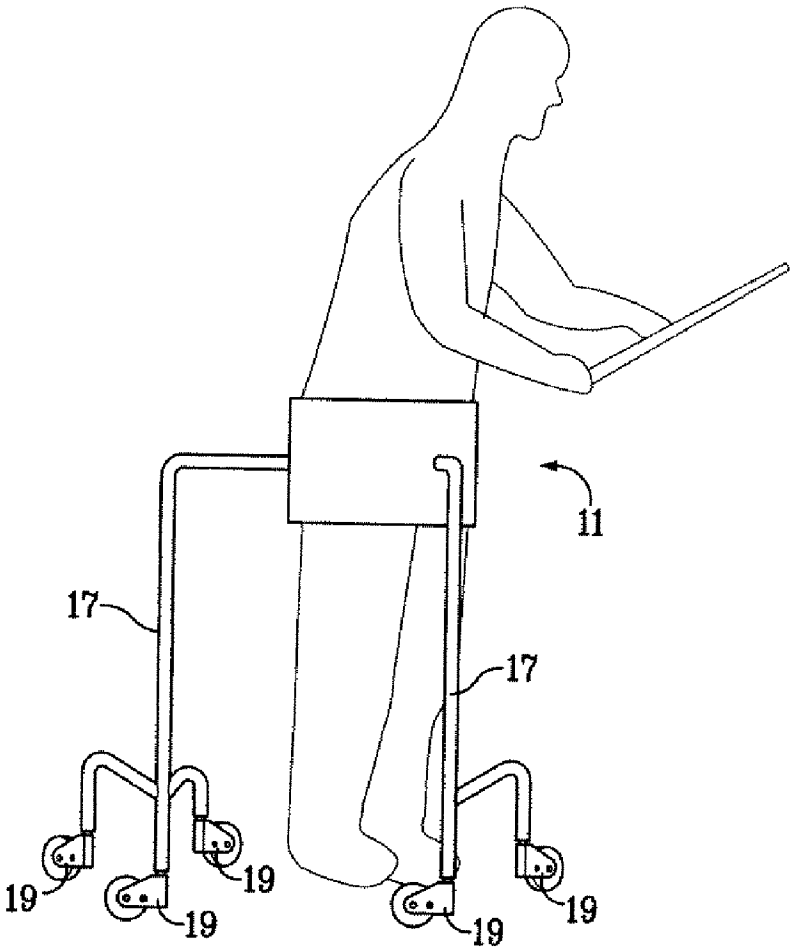
FIG. 1*a* is a side view of a user in the activity walker of FIG. 1 when configured for a larger footprint.

The present invention is a relatively light weight, reasonably small foot print activity walker with a minimal structure at the front. This reduces interference by the walker when the user is in close proximity to a fixed object.

At the foundation of the walker is a girdle-like structure 11, FIG. 1, which fits about the midriff of a user from about the lowest rib to slightly below the hips. This girdle-like structure has two necessary elements, a reasonably rigid trunk surround member 13 and a flexible sling support 15, shown in FIGS. 2, 3-4, and 7-8. The flexible sling support 15 is passed between the legs of a user and supports the user's "seat" region while the user is in the standing position or is walking about. The surround member 13 is supported by three legs 17 fixed thereto, which each have a caster wheel 19 at the bottom end. This permits the walker to move easily as the user moves. It also permits hands-free operation where the user is not required to grasp the walker to control its movement.

Figure 1:
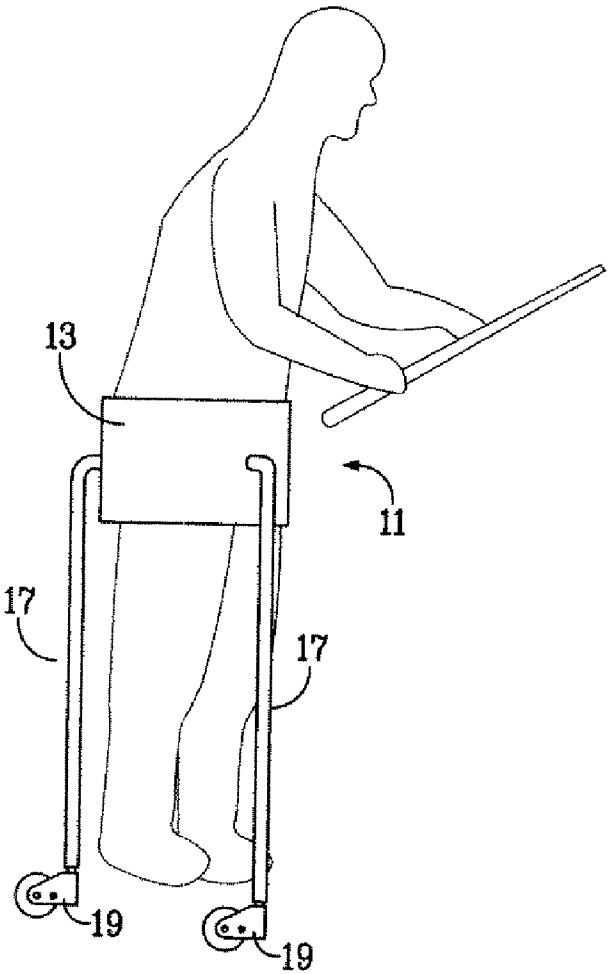
FIG. 1 is a side view of a user in the activity walker of the present invention, where the walker is configured in its normal (small) footprint.
Figure 6B:
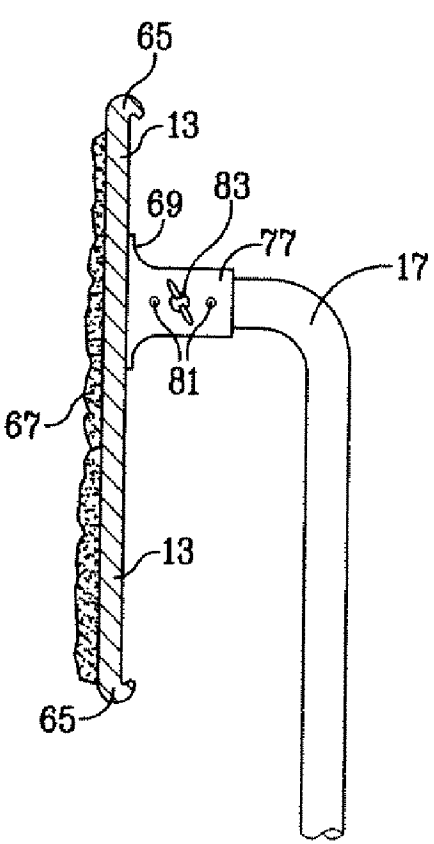
FIG. 6*b* is a side view of a tubular support leg attachment permitting an adjustment in the lateral extension of a leg to alter the walker's footprint.

Each leg 17, FIG. 1*a*, has a vertical portion and a horizontal portion mating at a right-angle bend, and can have a lateral adjustment, shown in FIG. 6*b*, in order to extend further laterally outwardly, FIG. 1*a*, to provide a larger footprint for the walker. This creates a more secure configuration for a less stable user.

Figure 2:
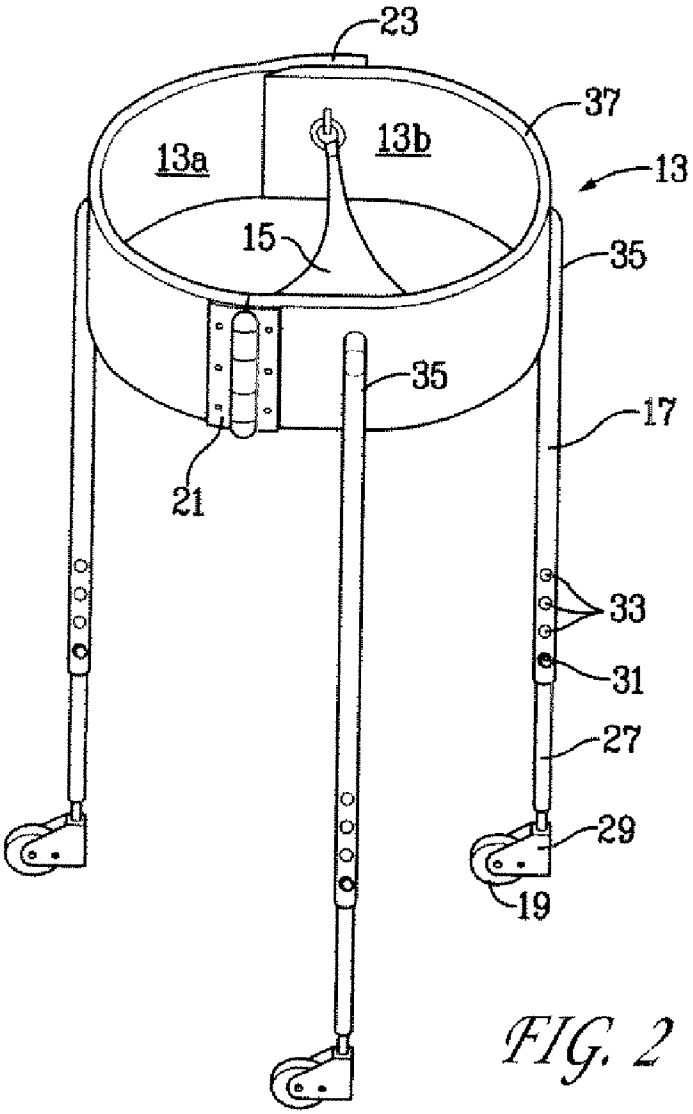
FIG. 2 is a perspective view of the activity walker.

The surround member 13, FIG. 2, has an oval-shaped cross-section to fit the average cross-sectional configuration of the midriff portion of a user, much as a belt would fit. Surround member 13 has two sections, 13*a*, 13*b*, and are joined by a hinge 21 at the back of the walker. The hinge 21 is off-set to one side slightly to provide room for the attachment of the sling support 15.

The surround member 13 sections are constructed of a rigid material such as metal, reinforced fiberglass, or a very rigid plastic. The first section 13*a* has a flexible free end 23 which carries an adjustable closure structure 25 shown in FIGS. 3 and 4. This closure has a mating part on the second section 13*b* to close the surround member 13 and to adjust the perimeter size of the girdle.

Figure 4:
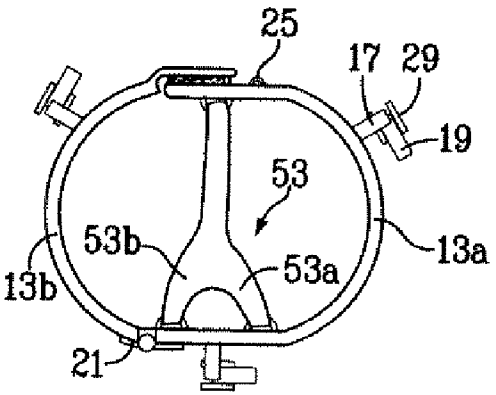
FIG. 4 is a top, plan view of the activity walker of FIG. 3 showing a second embodiment for the sling support member.
Figure 3A:
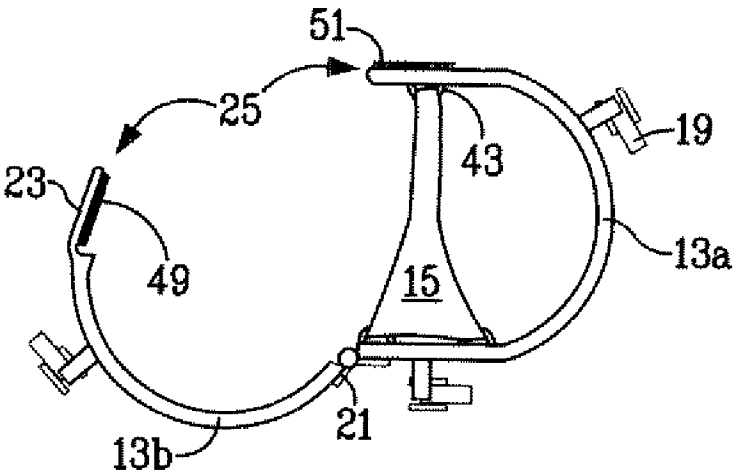
FIG. 3*a* is a top, plan view of the activity walker of FIG. 3 with the surround member hinged open.
Figure 3:
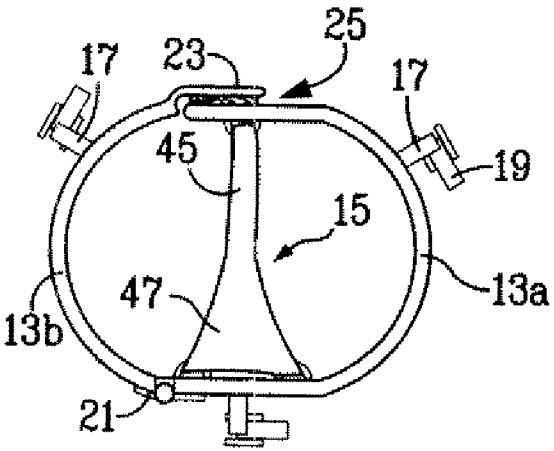
FIG. 3 is a top, plan view of the activity walker of FIG. 2 showing a first sling support member.

The three legs 17 are securely attached to the surround member 13 with a spacing between each of about ⅓ of the perimeter, FIGS. 2, 3 and 4. One of the legs 17 is positioned at the middle of the back of the surround member 13. The other two legs are positioned on either side of the user forward of the user's shoulders. This provides tip-over stability similar to a three-legged stool.

Figure 2A:
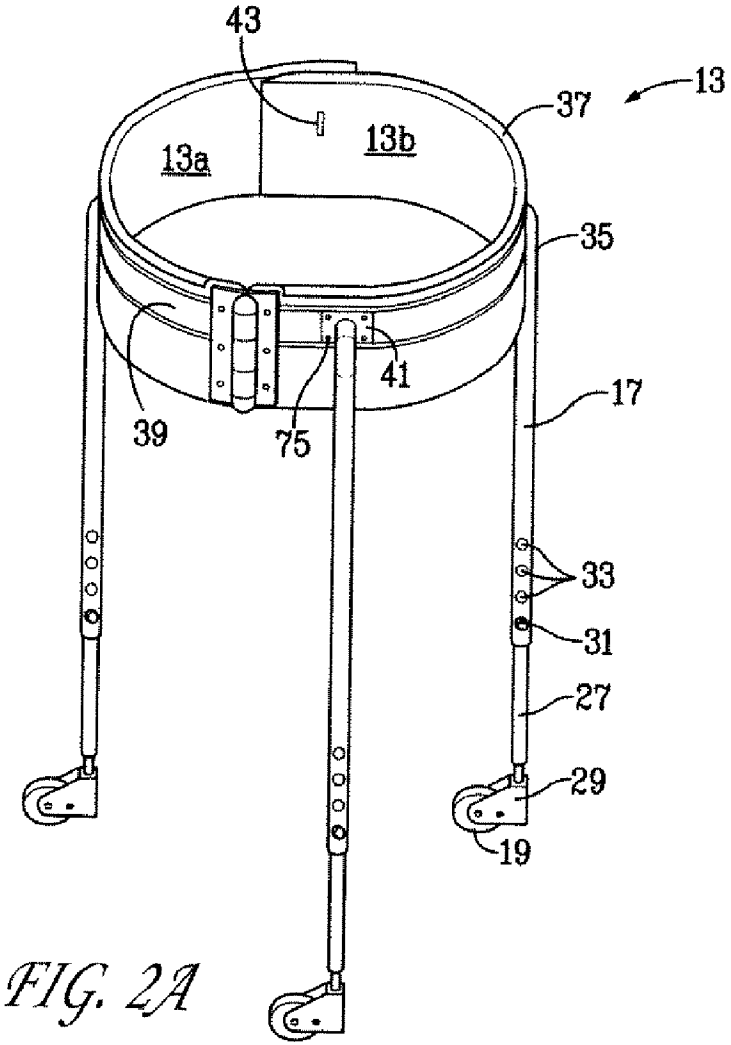
FIG. 2*a* is a perspective view of the activity walker of FIG. 2 having a leg attachment track for adjusting the individual positions of the legs.
Figure 5:
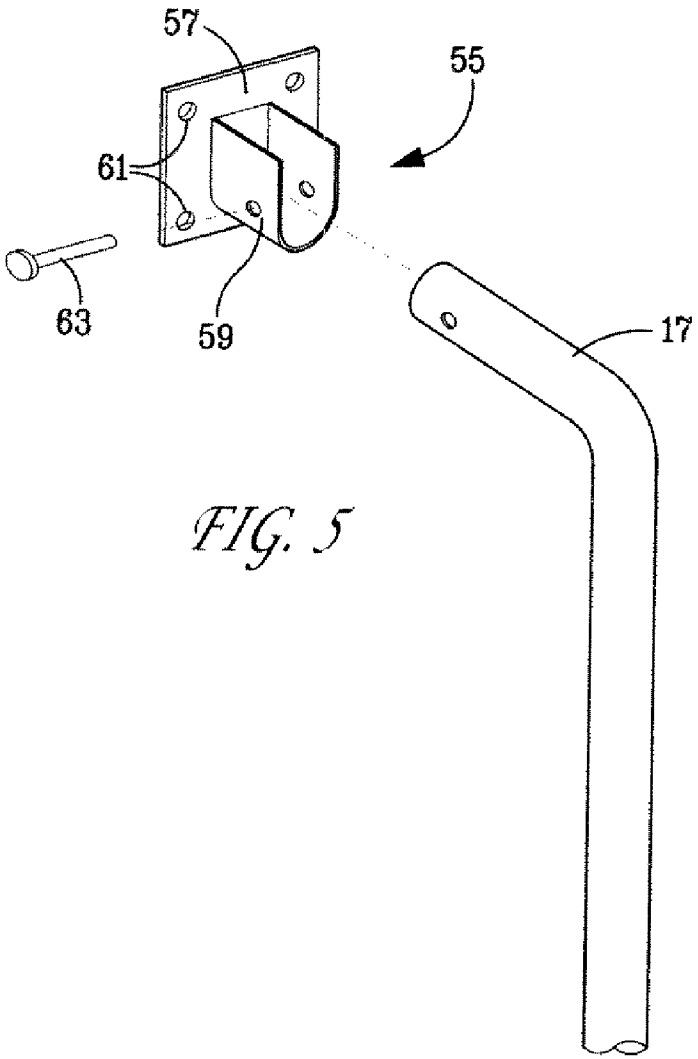
FIG. 5 is an exploded perspective view of an alternative leg bracket attachment structure.

Each leg 17 has an adjustable extension 27 which slides outwardly from its free end, FIGS. 2 and 2*a*. A caster bracket 29 carrying a caster wheel 19 is mounted onto the bottom free end of each extension 27. An adjustment to the length of each leg 17 is facilitated by a spring biased button-type detent 31, which can mate with any of a series of detent holes 33 of a particular leg 17. This provides a leg length adjustment in a series of fixed increments. As an alternative, a set screw may be employed where the length adjustments are continuous and almost infinite.

The legs 17 and extensions 27 are preferably made of metal. The top of each leg 17 has a 90 degree bend 35 transitioning from the vertical to the horizontal. The "horizontal run" for each leg 17 can be in the range of 2-4 inches, nominally, for a small footprint for the walker. The upper end of a leg 17 can be welded directly to the outside face of the surround member 13, FIG. 2. Welding provides an economical attachment when the legs 17 are not laterally adjustable and are also not adjustable for perimeter positioning, FIG. 2.

With other materials, space-age adhesives and supplemental supports can be used to attach each leg 17 to the surround member 13 with or without reinforcing brackets, rivets, and the like.

The surround member 13 has rounded upper and lower lips 37 to preclude having the wall of the surround member pinch, cut or dig into the user.

The position of each leg 17 can be adjustable about the perimeter of the surround member 13 if a track 39 is mounted to extend about the outside face of the surround member 13, FIG. 2*a*. The end of each leg 17 is fixedly secured to a bracket plate 41 which fits into the rails of the track 39. The position of a bracket plate 41 is fixed in the track 39 with a pair of set screws 75 or other attachment structure.

The front of the sling support is removably attached to a releasable catch 43 fixed on the inside face of the second, other section 13*b* of the surround member 13.

The sling support 15, FIGS. 3, 3*a* can be implemented in a number of shapes and sizes, as can the other structural members of the walker. The sling support 15 can have a shape approximating the profile of a road bicycle saddle. In this configuration the sling support 15 has a narrow "horn" portion 45 and a wider hip-support portion 47.

The surround member 13 is opened, FIG. 3*a*, to permit a user to enter. For user entry, the front of the sling support 15 is detached from its catch 43 and permitted to hang from its rear attachments. Once the user has entered the walker, the sling support 15 is passed between the legs of the user and securely attached to the catch 43. The surround member 13 is then closed about the midriff of the user with the adjustable closure 25.

This closure 25 which carries a loop member 49 of a VELCRO® strip connector on the inside face of the flexible free end 23 of the second surround section 13*b*, while the outside face of the first section 13*a* carries a hook member 51. The flexible free end 23 can overlap the first surround section 13*a* to tighten the surround member 13 about the midriff of a user. An adjustment is intended for a range of user midriff sizes.

Another type of flexible fastener can be substituted. Alternatives can include a leather belt and buckle, or a flexible woven or braided metal or plastic webbing with a series of reinforced attachment holes for mating with a metal turn latch on the first section 13*a*.

The sling support 15 can have bifurcated rear section 53, FIG. 4, with two legs 53*a*, 53*b*. Each of the first and second rear section legs 53*a*, 53*b* is individually riveted or otherwise permanently attached to the inside face of the first surround section 13*a*. The twin-leg 53*a*, 53*b*, bifurcated, rear section 53 gives has somewhat more sideways give, i.e., in a lateral direction, that the sling support 15 shown in FIGS. 3, 3*a*. While this alternate design will not provide as comfortable a support at the user's hips, when the user walks about this design is less prone to chafe the legs.

In the alternative, a U-shaped bracket 55 can be used to attach a leg 17 directly to the outside face of the surround member 13. This bracket 55 has a rectangular base plate 57 and a U-shaped plate 59 extending outwardly. The base plate 57 is riveted, tack welded or bolted 61 to the surround member 13. The U-plate 59 is shaped and sized to accept the horizontal portion of a leg 17 with a tight fit. A pin or bolt passes through holes in the walls of the U-plate 59 and through holes in the leg 17 to securely attach the leg 17 to the bracket 55. The bracket 55 permits the leg 17 to be selectively mounted to and removed from the surround member 13, for storage, cleaning or replacement. The bracket 55 adds strength and stiffness to the leg 17 attachment to the surround.

Figure 7:
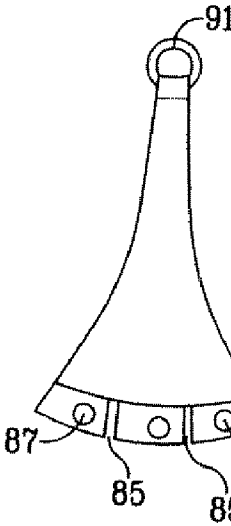
FIG. 7 is a top, plan view of the sling support member of FIG. 3.
Figure 10:
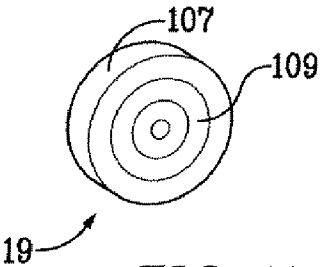
FIG. 10 is a perspective view of a wheel used with the caster bracket of FIGS. 9, 9*a*.
Figure 7A:
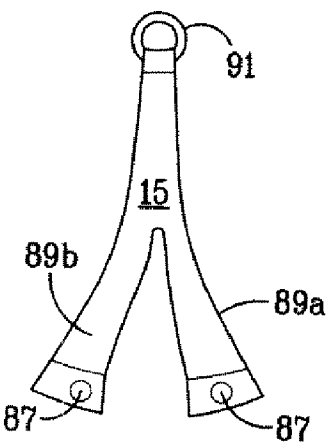
FIG. 7*a* is a top, plan view of a third design for the sling support member.

The sling support 15 has a narrow elongate front portion and a widened back portion as seen in FIGS. 7, 7A. The outline shape of the sling support 15 is Y-shaped with a narrow elongate front portion and a flared back portion. When a sling support 15 without bifurcated legs is employed, FIG. 7, the rear attachment edge can have slits 85 and grommet reinforced holes 87 for attachment to the wall of the surround first section 13*a*.

Figure 6A:
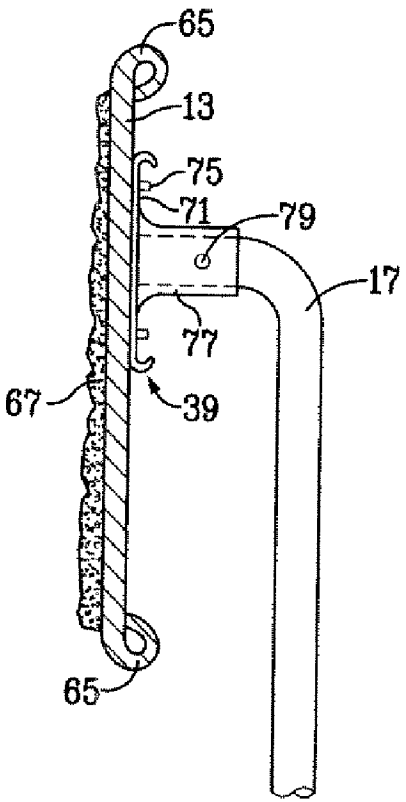
FIG. 6*a* is a side view of a tubular support leg attachment.
Figure 6:
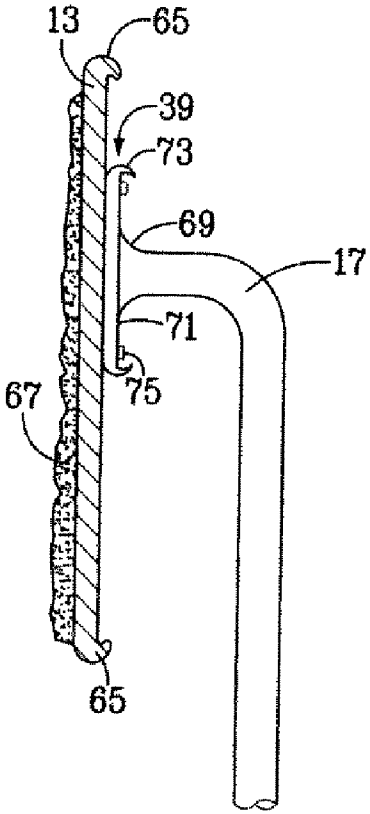
FIG. 6 is a side view of a welded support leg attachment.
Figure 8:
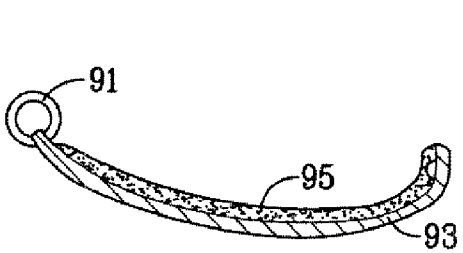
FIG. 8 is a cross-sectional view of the third embodiment of the sling support member of FIG. 7*a;*

In the embodiment of FIG. 6 the upper end of the leg 17 is welded 69 directly to a mounting plate 71. The mounting plate 71 is held within a track 39 which has upper and lower retaining lips 73. The position of the mounting plate 71 and therefore the attached leg 17 is fixed by a plurality of four set screws 75. With this embodiment each leg 17 can be repositioned about the surround 13.

The embodiment of FIG. 6*a* also includes a track 39 mounted on the surround 13 outer face with a mounting plate 71 positioned in the track 39 and held there by set screws 75. However, the upper end of the leg 17 is not connected directly to the mounting plate 71. In this embodiment, a cylindrical sleeve is welded or otherwise attached to the mounting plate 71. The upper end of the leg 17 is positioned within the sleeve 77 the entire length of its horizontal extension and held therein by a selectively removable fastener 77. The sleeve 77 provides enhanced rigidity to the leg 17.

In the embodiment of FIG. 6*b*, the cylindrical sleeve 77 is welded 69 directly to the outside face of the surround 13. The sleeve 77 carries a series of adjustment holes 81. This permits an adjustment to the point of attachment of the upper end of a leg 17 and an adjustment of the lateral extension of a leg 17 away from the surround. A spring biased detent button can be used to adjust the lateral (horizontal) position of the leg 17 outwardly from the surround 13. In the alternative, a removable thumb screw 83 is used instead of the detent button. Such thumb screw is not as convenient, but is more secure.

FIGS. 6, 6*a*, and 6*b* show a side view of a leg 17 attachment to the surround 13 and a cross-section of the surround 13. The surround walls have outward curved lips 65 at the top and bottom edges. The curved lips 65 can open, FIGS. 6 and 6*b*, or curled completely, FIG. 6*a*. The inner face of the surround member 13 is covered with a cushion or padding material 67. The thickness of this cushioning can be varied to meet the needs of the intended user. Likewise, the composition of the padding 67 can be chosen from vinyl covered foam to a cloth covered memory foam, to an inflatable bladder which will assist in adjusting the size of the girdle action of the surround structure.

The bifurcation of the sling support 15, FIG. 7*a*, can be cut more severely which will result in thinner legs 89*a*, 89*b* and even more enhanced flexibility. The front end of the sling support has a ring 91 attached for being engaged by the releasable catch 43. This ring assists in the positioning of the front end of the sling support 15. The rear end of each leg 89*a*, 89*b*, has a grommet reinforced rear attachment hole 87.

The sling support 15 can be constructed of any of various materials, including belt leather, woven nylon or rayon, or a metal mesh or polymer mesh. When the sting support 15 is made of a mesh material 93, FIG. 8, a padding 95 is bonded to the user-facing surface. Stranded (parallel strands of line, cord or rope) construction and a mesh construction provide the greatest lateral flexibility for a sling support 15.

Figure 9:
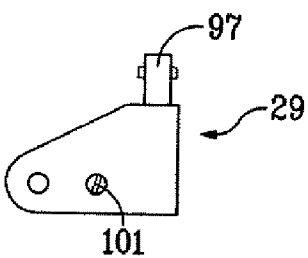
FIG. 9 is a side view of a wheel caster bracket showing a friction pin.
Figure 9A:
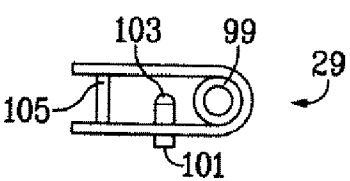
FIG. 9*a* is a top, plan view of the wheel caster bracket of FIG. 9 showing the friction pin.

The caster wheels 19 are each held in a caster bracket 29, FIGS. 9 and 9*a*. Each bracket 29 has a vertically projecting shaft 97 which snaps into the lower end of a leg extension 27. The shaft 97 interfaces with the bracket 29 with a bearing structure 99. An adjustable friction pin 101 passes through a wall of a bracket 29 to press against the caster wheel 19 held in the bracket. Each pin has a wear end having a friction pad 103. Each pin also has calibration markings along its length for pressure calibration. The caster wheel 19 rides on a bearing shaft 105 which bridges the bracket 29.

Each caster wheel 19 has a rubber or plastic tread 107 which provides a smooth, reasonably silent roll. On the side of each caster wheel 19 facing the friction pin 101 is an annular-shaped wear ring 109. Each friction pin 101 is either adjusted for free roiling of its caster wheel 19 or adjusted to apply some friction which acts like a braking force to increase the force needed to turn each wheel 19. Therefore, by adjusting each friction pin 101 the free wheeling of the walker can be adjusted as needed for the immediate conditions of its use.

Many changes can be made in the above-described invention without departing from the intent and scope thereof. For example, the vertical position of the surround 13 can be raised to surround the user at a higher position. Or the vertical height of the surround 13 can be extended. The sting support 15 can be made longer to droop in the middle. The leg 17 length can be adjusted for the user to rest on the sling support 15 in a near-sitting position or in an actual sitting position. Or an outrigger leg can be added to each leg for enhanced stability. Such outrigger leg can have a quad-leg, tri-leg, bi-leg, or single leg design.

It is therefore intended that the above description be read in the illustrative sense and not in the limiting sense. Substitutions and changes can be made while still being within the scope and intent of the invention and of the appended claims.

What is claimed is:

1. An activity walker suitable as a standing and walking aid for an aged or informed individual user, comprising:

a rigid cylinder-shaped trunk surround member adapted to surround a user in close proximity to the torso of said user, said surround member having a front portion adapted to be adjacent to the front of the user and a rear portion adapted to be adjacent to the back of a user, said front portion and rear portion of said surround member being joined at one end each thereof by a hinge and joinable at the other end each thereof by a flexible closure;

three vertically extending support legs attached about said surround member with an attachment and positioned thereabout with one leg positioned at a middle of the rear portion of the surround member and the other two legs in the front portion of said surround member forward of the position of said user's shoulders;

wherein the position of said other two legs leaves the front of said surround member relatively unencumbered; and a flexible sling support adapted for both a user seat and walking support, said sling support being securely attached at its rear/back portion to the interior of said surround member at a first location at the rear portion of the surround member and releasably attached at its front portion to the interior of said surround member at a second location opposite the first location, said sling support adapted to pass between the legs of the user when so attached.

2. The walker of claim 1, wherein said sling support is Y-shaped with a narrow elongate front portion and a flared rear portion.

3. The walker of claim 2, wherein said sling support flared rear portion includes a rear attachment edge and plurality of slits extending thereinto.

4. The walker of claim 3, wherein said sling support is made of mesh material with padding bonded to an upper user-facing surface.

5. The walker of claim 2, wherein said sling support rear portion is split into two legs.

6. The walker of claim 5, wherein said sling support is made of mesh material with padding bonded to the user-facing surface.

7. The walker of claim 2, wherein said surround member has its top and bottom edges outward curled in a closed curl.

8. The walker of claim 2, also including a caster wheel assembly on the bottom of each leg, said assembly including a caster wheel having a wear ring and a friction pin adapted for contact with said wear ring having calibration markings.

9. The walker of claim 8, wherein each friction pin has a wear end adapted to engage the wear ring for adjusting the rolling rate of the caster wheel.

10. The walker of claim 9, wherein said legs are each vertically adjustable in length in increments.

11. The walker of claim 2, wherein said support legs each have a right angle bend at the upper end thereof wherein the leg then extends to said attachment to the surround member.

12. The walker of claim 11, wherein each said supporting leg having a caster wheel assembly is a tripod/triple wheel assembly.

13. The walker of claim 12, wherein said legs are each vertically adjustable in length in increments.

14. The walker of claim 2, wherein said support legs each have a right angle bend at the upper end to form a horizontal extension thereof wherein each leg then extends horizontally to said surround member for said attachment thereto, each said attachment including a bracket mounted to an outer face of said surround member and a fastener attaching said leg horizontal extension to said bracket and permitting said leg removal therefrom.

15. The walker of claim 14, wherein each said bracket has a series of adjustment holes wherein said horizontal extension of each leg is adjustable horizontally outwardly from said surround member.

16. The walker of claim 14, wherein said legs are each vertically adjustable in length in increments.

17. The walker of claim 2, wherein said support legs each have a right angle bend at the upper end thereof wherein each leg then extends horizontally to said surround member for said attachment thereto, each said attachment including a bracket mounted to an outer face of said surround member, said walker also including:

a track extending around the outer face of said surround member, wherein each said bracket is mounted in said track and adapted to be moved along said track and thereby to different positions about said surround member, and a plurality of set screws through each said bracket for fixing each said bracket at a desired location along said track.

18. The walker of claim 17, wherein said legs are each vertically adjustable in length in increments.

19. The walker of claim 2, wherein said legs are each vertically adjustable in length in increments.

* * * * *

UNITED STATES PATENT AND TRADEMARK OFFICE

CERTIFICATE OF CORRECTION

PATENT NO. : 7,735,499 B1
APPLICATION NO. : 12/276521
DATED : June 15, 2010
INVENTOR(S) : Paul A. Pennise It is certified that error appears in the above-identified patent and that said Letters Patent is hereby corrected as shown below:

Col. 7, line 21 (Claim 1) delete "informed" and replace with --infirmed--.

Signed and Sealed this

Twenty-first Day of September, 2010

David J. Kappos

David J. Kappos
*Director of the United States Patent and Trademark Office*